United States Patent [19]

Blanchard

[11] Patent Number: 4,643,686

[45] Date of Patent: Feb. 17, 1987

[54] STEERING POST MOUNTED PROPULSION ASSEMBLY

[75] Inventor: Clarence E. Blanchard, Kenosha, Wis.

[73] Assignee: Outboard Marine Corporation, Waukegan, Ill.

[21] Appl. No.: 752,842

[22] Filed: Jul. 8, 1985

Related U.S. Application Data

[62] Division of Ser. No. 211,642, Dec. 1, 1980, Pat. No. 4,563,155.

[51] Int. Cl.[4] ..... B63H 25/42

[52] U.S. Cl. ..... 440/51; 440/61; 114/162

[58] Field of Search ..... 114/162–164, 114/39; 440/53, 61, 900, 51, 62; 248/640–643

[56] References Cited

U.S. PATENT DOCUMENTS 3,839,986 10/1974 Meyer et al. ..... 440/61

4,089,290 5/1978 Miles et al. ..... 440/61

4,232,627 11/1980 Glenn et al. ..... 440/61

4,290,760 9/1981 Lindblad ..... 114/162

*Primary Examiner*—Trygve M. Blix

*Assistant Examiner*—Stephen P. Avila

*Attorney, Agent, or Firm*—Michael, Best & Friedrich

[57] ABSTRACT

Disclosed herein is a marine propulsion device for a boat hull having a transom, which device comprises a steering post having a longitudinal axis and adapted to be connected to the boat transom for rotation about the longitudinal axis, a propulsion assembly including a rotatably mounted propelling element, and linkage connecting the propulsion assembly and the steering post for common pivotal movement about the longitudinal axis and for movement of the propulsion assembly relative to the steering post between a running position and a second position elevated from the running position and against steering movement of the propulsion unit assembly relative to the steering post.

3 Claims, 5 Drawing Figures

STEERING POST MOUNTED PROPULSION ASSEMBLY

RELATED APPLICATION

This is a division of application Ser. No. 211,642 filed Dec. 1, 1980, now U.S. Pat. No. 4,563,155, issued Jan. 7, 1986.

Attention is directed to my related U.S. Pat. No. 4,501,562, issued Feb. 26, 1985.

BACKGROUND OF THE INVENTION

The invention relates generally to marine propulsion devices and, more particularly, to marine propulsion devices adapted for propelling sailboats which are commonly steered by a rubber located either under the hull or behind the transom.

In the past, outboard motors have sometimes been mounted on the transom of a sailboat, but, in general, such mounting has been relatively inaccessible, and consequently, the steering capability of the outboard motor was seldom used and the propeller was often undesirably trailed in the water when the boat was under sail. In addition, in instances when the rudder was mounted on the transom, the outboard motor had to be mounted to one side in an inefficient location.

Attention is directed to the following U.S. patents:

Jeanson—U.S. Pat. No. 4,143,614 issued Mar. 13, 1979
Krautkremer—U.S. Pat. No. 3,683,841 issued Aug. 15, 1972
Adams—U.S. Pat. No. 3,809,343 issued May 7, 1974
Moberg—U.S. Pat. No. 3,581,702 issued June 1, 1971
Roberts—U.S. Pat. No. 4,004,705 issued Aug. 30, 1977
Wagner—U.S. Pat. No. 3,096,959 issued July 9, 1963
Forbes—U.S. Pat. No. 2,908,242 issued Oct. 13, 1959
Briggs—U.S. Pat. No. 2,178,555 issued Nov. 7, 1939
Corcoran—U.S. Pat. No. 1,800,135 issued Apr. 7, 1931

SUMMARY OF THE INVENTION

The invention provides a marine propulsion device for a boat hull having a transom, which device comprises a steering post having a longitudinal axis and adapted to be connected to the boat transom for rotation about the longitudinal axis, a propulsion assembly including a rotatably mounted propelling element, and means connecting the propulsion assembly and the steering post for common pivotal movement about the longitudinal axis and for movement of the propulsion assembly relative to the steering post between a running position and a second position elevated from the running position and against steering movement of the propulsion unit assembly relative to the steering post.

In one embodiment of the invention, the marine propulsion device further includes a rudder element connected to the steering post for common movement therewith about the longitudinal axis of the steering post.

In one embodiment of the invention, the means connecting the propulsion assembly and the steering post includes a bracket member which is fixed to the steering post for common movement therewith, which has a part extending radially of the longitudinal axis, and which is connected to the propulsion assembly, and wherein the rudder element is fixedly connected to the bracket member part.

In one embodiment in accordance with the invention, the means connecting the propulsion assembly and the steering post includes means for pivotally connecting the propulsion assembly to the steering post about an axis which is horizontal when the steering post is boat mounted and for selectively displacing the propulsion assembly relative to the steering post between the running position and the spaced position.

In one embodiment in accordance with the invention, the means connecting the propulsion assembly and the steering post includes means for selectively rectilinearly displacing the propulsion unit assembly relative to the steering post between the running position and the second position.

In one embodiment in accordance with the invention, the means for selectively rectilinearly displacing the propulsion assembly displaces the propulsion assembly generally vertically.

In one embodiment in accordance with the invention, the means for selectively rectilinearly displacing the propulsion assembly further includes means for preventing pivotal movement in a vertical plane of the propulsion assembly with respect to the link.

In one embodiment in accordance with the invention, the means for selectively rectilinearly displacing the propulsion assembly comprises a link which is extensible and contractable and which is connected, at one end, to the steering post and connected, at the other end, to the propulsion assembly.

Other features and advantages of the embodiments of the invention will become known by reference to the following general description, claims and appended drawings.

IN THE DRAWINGS

Figure 3:
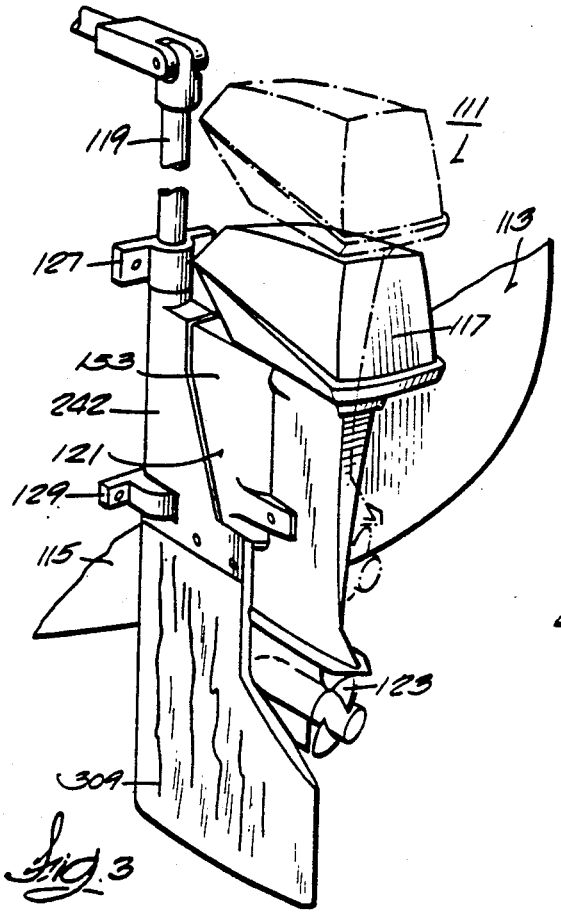
FIG. 3 is a perspective view of a second embodiment of a marine propulsion device which embodies various of the features of the invention and which is shown with the propulsion assembly in the running position in full lines and in the raised or elevated position in dotted outline.

Before explaining one embodiment of the invention in detail, it is to be understood that the invention is not limited in its application to the details of construction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

GENERAL DESCRIPTION

Shown in the drawings is a marine propulsion installation 11 including a boat hull 13 having a transom 15 and a marine propulsion device 17 comprising a steering post 19 having an upright longitudinal axis, together with means vertically mounting the steering post 19 on the rear of the boat transom 15 for pivotal movement about its longitudinal axis. In addition, the marine propulsion device 17 includes a propulsion assembly 21 including a propeller 23, and means 25 connecting the propulsion assembly 21 to the steering post 19 for common pivotal movement about the axis of the steering post 19, and for movement of the propulsion assembly 21 relative to the steering post 19 between a lower running position (shown in full lines) with the propeller 23 in the water and a raised position above the running position (shown in dotted lines) and preferably with the propeller 23 out of the water, and against steering movement of the propulsion assembly 21 relative to the steering post 19.

While other constructions could be employed, the steering post 19 comprises an elongated cylindrical rod or element which is rotatably journalled by a pair of spaced upper and lower transom brackets 27 and 29 fixed to the bracket transom 15. At its upper end, the steering post 19 terminates in a vertically extending ear 31 which is received between a pair of spaced lugs 35 provided on the rearward end of a fragmentarily illustrated tiller arm 37. The tiller arm 37 is connected to the ear 31 of the steering post 19 by a suitable pin 39 which extends through the ear 31 and the lugs 35 so that horizontal swinging movement of the tiller arm 37 causes associated pivotal movement of the steering post 19 about its axis.

The propulsion assembly 21 comprises a propulsion unit 51 which includes the propeller 23 and which can be generally of conventional construction, together with a connecting bracket 53 which is fixedly secured to the propulsion unit 51 except that elastomeric mounts (not shown) are preferably employed between the connecting bracket 53 and the propulsion unit 51 so as to vibrationally isolate the connecting bracket 53 from the propulsion unit 51. As a consequence, minor immaterial movement of the propulsion unit 51 relative to the connecting bracket 53 is afforded. However, for practical purposes, the propulsion unit 51 and connecting bracket 53 are rigidly secured together.

The propulsion unit 51 comprises a powerhead 55 including an internal combustion engine 57, together with a lower unit 59 which includes a drive shaft housing 61 rigidly secured to the bottom of the powerhead 55, and a gear case 63 which is rigidly secured to the bottom of the drive shaft housing 61 and which rotatably supports a propeller shaft 65 carrying the propeller 27. Extending through the drive shaft housing 61 is a drive shaft 67 which is drivingly connected to the engine 57 and to a reversing transmission 69 located in the gear case 63 and connected to the propeller shaft 65.

The connecting bracket 53 is connected to the drive shaft housing 61 at vertically spaced points, indicated generally at 71 and 73, and extends forwardly and upwardly therefrom by means including a pair of laterally spaced legs 75 having forwardly and upwardly located end portions 77 including respective, laterally, aligned transverse bores 79.

Various means can be provided for connecting the propulsion assembly 21 to the steering post 19 for common pivotal movement and for displacement of the propulsion assembly 21 between the lower running position and the elevated position. In the construction illustrated in FIGS. 1 and 2, such means includes a link or bracket 81 which is fixed by any suitable means to the lower end of the steering post 19 and which, in part, constitutes an extension thereof. In this last regard, the lower forward end of the bracket 81 is provided with a slot 83 which receives the lower transom bracket 29 and the bracket 81 is bored from the bottom in axial alignment with the steering post 19. A steering pintle bolt 85 extends into the bottom of the bore, through the lower transom bracket 29 and is threaded into the bracket 81 to afford a lower support for pivotal steering movement of the steering post 19.

The bracket 81 includes a pair of laterally spaced wing portions 87 which extend rearwardly from a forward part of the bracket 81 and which have a rearward extent which increases with the downward extent of the wings. Thus, the wing portions 87 generally take the shape of a 90°-45°-45° triangle with the hypotenuse leg extending rearwardly and downwardly. The wing portions 81 are laterally spaced apart at a distance greater than the legs 75 of the connecting bracket 53 so as to permit disposition of the connecting bracket legs 75 in inwardly adjacent relation to the wing portion 35 of the bracket 81 for transmission therebetween of side thrust. The wing portions 87 include, adjacent the top thereof, respective, laterally aligned bores 89.

The means 25 connecting the propulsion assembly 21 to the steering post 19 for pivotal movement of the propulsion assembly 21 in common with the steering post 19 also provides for pivotal movement of the propulsion assembly 21 relative to the steering post 19 between the running position and the raised or tilt position and includes, in addition to the transverse bores 79 and 89, a tilt pin or link 91 which extends horizontally and through the bores 79 and 89 and which, together with the bores 79 and 89, prevents relative movement between the propulsion assembly 21 and the steering post 19 except for the just mentioned pivotal tilting movement. More specifically, the connection of the propulsion assembly 21 to the steering post 19 does not provide for steering movement of the propulsion assembly 21 relative to the steering post 19.

Means 92 are provided for selectively tiltably displacing the propulsion assembly 21 upwardly about the horizontal tilt axis provided by the tilt pin 91 from the lowered running position to the elevated or raised tilt position with the propeller 23 desirably located out of the water. While various arrangements can be employed, in the illustrated construction, such means 92 comprises a link 93 which is expansible and contractable, which, at one end, is pivotally connected to the bracket 81 by a pin 95 and which, at the other end, is pivotally connected by a pin 97 to the connecting bracket 53. Any suitable expandable link can be employed. In the illustrated construction, the link 93 comprises a hydraulic cylinder-piston assembly. Any suitable means (not shown) can be employed for controllably supplying and draining pressure fluid to and from the opposite ends of the cylinder so as to pivotally displace the propulsion assembly 21 between the lowered running position and the raised tilt position with the propeller 23 out of the water.

In order to facilitate substitution of rudder members of differing shapes to accommodate differing installation requirements, the bracket 81 includes, at its lower end, a rearwardly extending part or foot 105 which has a substantial radial extent beyond the outer end of the wing portions 87, and which is provided, on the under surface thereof, with a radially and rearwardly extending slot 107 which receives the upper margin of a suitably formed rudder member 109. Any suitable means can be employed to maintain the rudder member 109 in the slot 107, such as a series of bolts 110 extending through an aligned series of apertures.

Figure 4:
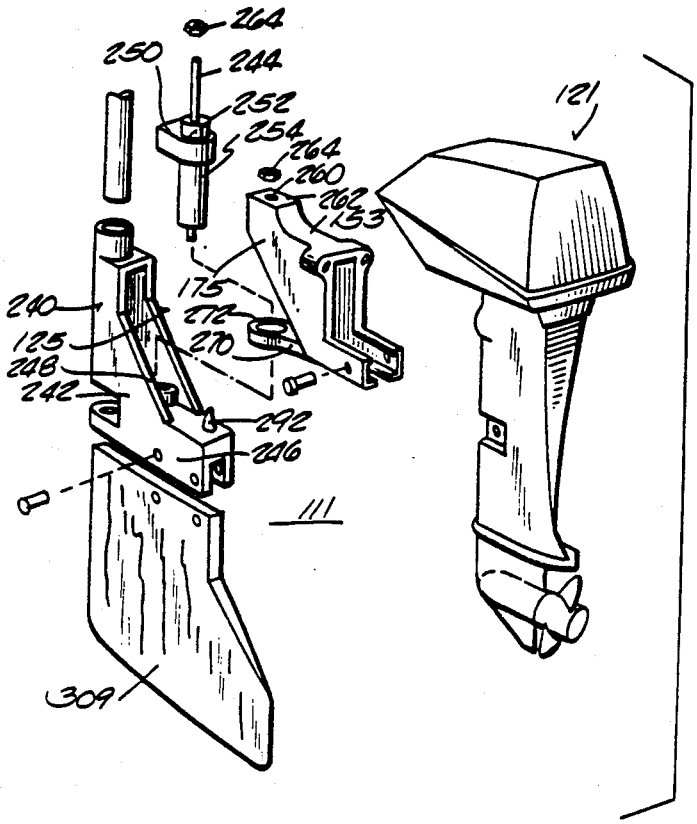
FIG. 4 is an exploded perspective view of the marine propulsion device shown in FIG. 3.
Figure 5:
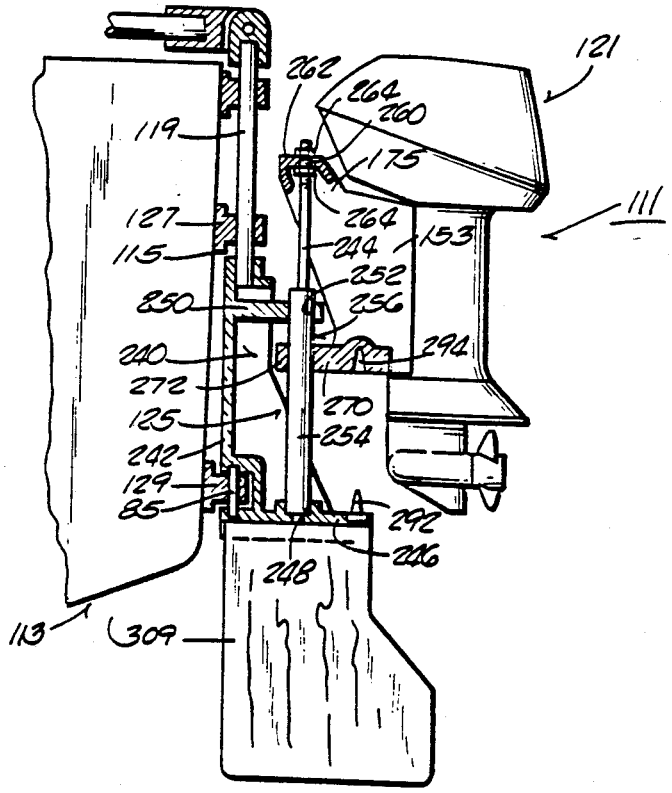
FIG. 5 is a side elevational view, partially in section of the marine propulsion device shown in FIG. 3 and with the propulsion assembly shown in the raised position.

Shown in FIGS. 3, 4 and 5 is another marine propulsion installation 111 including a boat hull 113 having a transom 115 and a marine propulsion device 117 comprising a steering post 119 having a longitudinal axis, together with means vertically mounting the steering post 119 on the rear of the boat transom 115 for pivotal movement about its longitudinal axis. In addition, the marine propulsion device 117 includes a propulsion assembly 121 including a propeller 123, and means 125 connecting the propulsion assembly 121 to the steering post 119 for common pivotal movement about the axis of the steering post 19 and for generally vertical rectilinear movement of the propulsion assembly 121 relative to the steering post 119 between a lowered running position with the propeller 123 in the water and a raised position above the running position and preferably with the propeller 123 out of the water, and against steering movement of the propulsion assembly 121 relative to the steering post 119.

Figure 1:
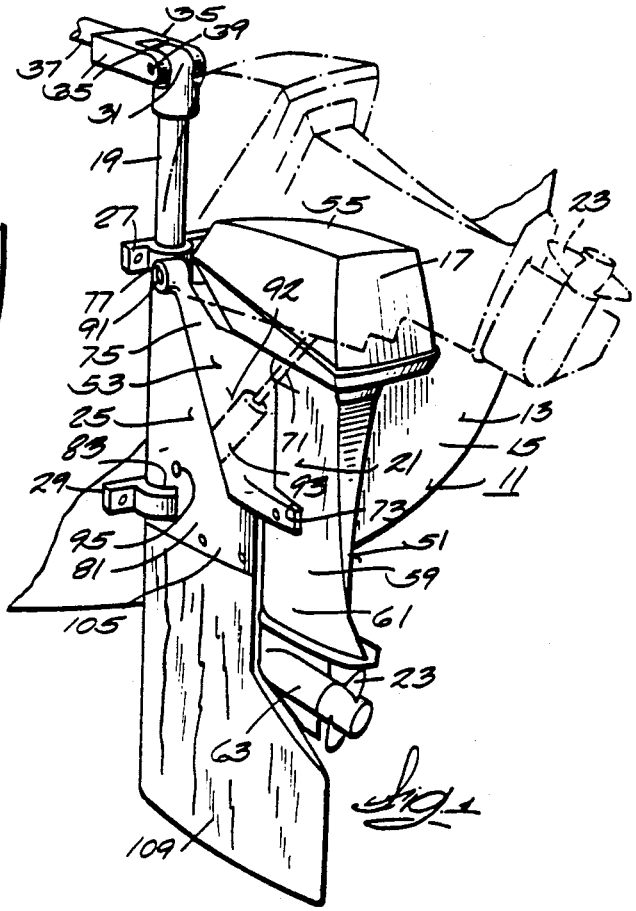
FIG. 1 is a perspective view of one embodiment of a marine propulsion device which embodies various of the features of the invention and which is shown with the propulsion assembly in the running position in full lines and in the raised or elevated position in dotted outline.
Figure 2:
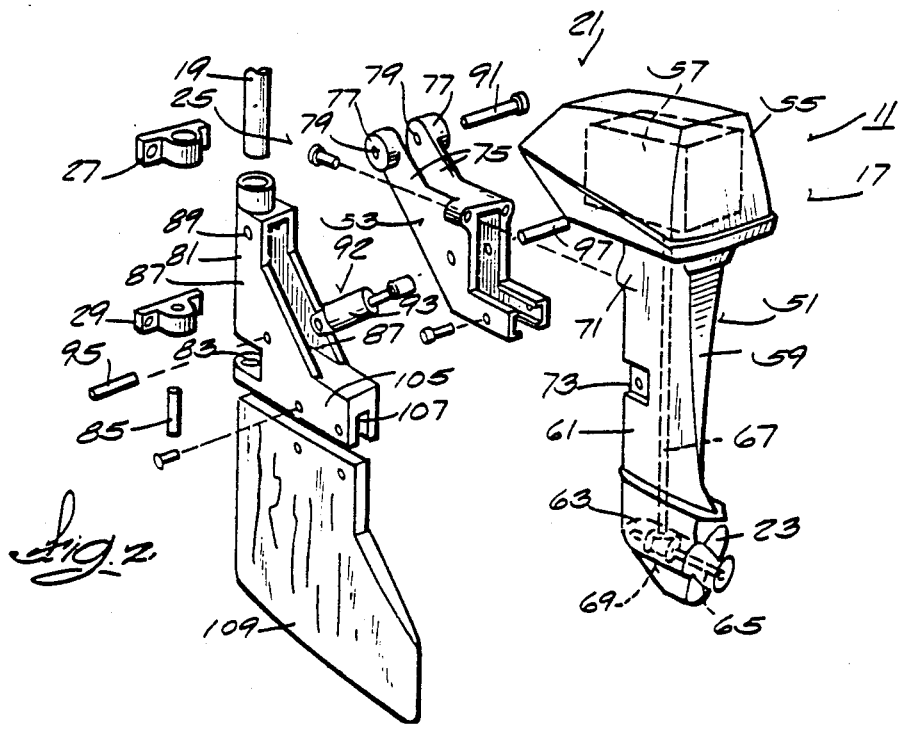
FIG. 2 is a partial, exploded perspective view of the marine propulsion device shown in FIG. 1.

The construction of the steering post 119 and transom brackets 127 and 129 is generally identical to the construction of the steering post 19 and transom brackets 27 and 29 already disclosed with respect to the embodiment shown in FIG. 1 and thus no further description will be provided. In addition, the construction of the propulsion assembly 121 is generally identical to the construction of the propulsion assembly 21 shown in FIG. 1, except as will be explained hereinafter. Accordingly, except for disclosure hereinafter, it is understood that the propulsion assembly 121 is otherwise identical to the propulsion assembly 21 and no further general description will be provided.

In the embodiment shown in FIGS. 3, 4, and 5, the means 125 connecting the steering post 119 to the propulsion assembly 121 for displacing the propulsion assembly 121 between the lowered running position and the raised or elevated position comprises an extendable bracket assembly 240 including a bracket or link 242 and a member or link 244 which is extendable and retractable relative to the bracket 242, together with means connecting the outer end of the extendable member 244 to the upper end of the connecting bracket 153 of the propulsion assembly 125. In addition, the connecting means 125 also includes means preventing pivotal movement of the propulsion assembly 121 relative to the bracket assembly 240 in the vertical plane and guidance of rectilinear movement of the propulsion assembly 121 vertically relative to the steering post 119.

The construction of the bracket 242, except as will hereinafter be referred to, is similar to the construction of the bracket 81 embodied in the marine propulsion device 11 shown in FIG. 1 and, accordingly, only the differences between the brackets 242 and 81 will be described. In this regard, the lower part or foot 246 of the bracket 242 (See especially FIG. 5) includes an upwardly opening socket 248. The bracket 242 also includes, in spaced relation above the foot 246, a rearwardly extending arm 250 having therein an annular socket 252. Received in the sockets 248 and 252 in spaced parallel relation to the bracket 242 is a cylinder 254 forming a part of a cylinder-piston assembly 256 which also includes a piston rod which constitutes the extendable member 244. Any suitable means, such as one or more set screws or clamps (not shown), can be employed for fixedly connecting together the bracket 242 and the cylinder 254. If desired, the bracket 242 and the cylinder 254 can be unitarily constructed in one piece.

While various other arrangements can be employed to connect the upper end of the piston rod 244 to the connecting bracket 153, in the illustrated construction, the upper end of the piston rod 244 is threaded and extends through an aperture 260 in a horizontally extending web 262 connecting the upper ends of the connecting bracket legs 175. The bores 89 shown in FIG. 2 can be omitted. The piston rod 244 is fixed to the connecting bracket or member 153 by locking nuts 264 threaded onto the piston rod 244 above and below the web 262.

While various arrangements can be employed for preventing pivotal movement of the propulsion assembly 121 in the vertical plane relative to the bracket assembly 240 and for guiding rectilinear vertical movement of the propulsion assembly 121 relative to the bracket assembly 240, in the embodiment disclosed in FIGS. 3, 4, and 5, such means comprises construction of the connecting bracket 153 with a downwardly and forwardly extending leg 270 having, at its outer end, a ring portion 272 which encircles the cylinder 254 so as to both prevent pivotal movement in the vertical plane and to guide vertical rectilinear movement of the propulsion assembly 125 relative to the bracket assembly 240 and relative to the transom bracket 121. As illustrated, the ring portion 272 extends, in part, between the cylinder 254 and the bracket 242.

In order to increase the rigidity of the connection of the propulsion assembly 121 to the bracket assembly 240 when the propulsion assembly 121 is in its lowered running position relative to the bracket assembly 240, the foot 246 on the bracket assembly 240 and the undersurface of the connecting bracket 153 are provided with interfitting pilot means. More specifically, while other constructions could be employed, in the illustrated construction, such pilot means comprises a conical pilot 292 on one of the foot 246 of the bracket assembly 240 and the connecting bracket 153 (on the foot 246 in the disclosed construction) and a mating aperture 294 in the other of the foot 246 and connecting bracket 153 (in the connecting bracket 153 in the disclosed construction). Thus, when the connecting bracket 153 is displaced toward its lower running position, the conical pilot 292 enters into the aperture 294 to provide additional rigidity.

Any suitable means can be employed to controllably supply hydraulic fluid to the opposite ends of the cylinder 254 so as to displace the propulsion assembly 121 between the raised out of the water position and the lowered running position with the propeller 127 in the water. Furthermore, when in the running position, the pilot 292 interfits with the aperture 294 in the connecting bracket 153 to provide further rigidification between the connecting bracket 153 and the bracket assembly 240.

As in the marine installation shown in FIG. 1, a rudder member 309 is connected to the foot 246 of the bracket 242 in the manner disclosed in FIG. 1.

Various of the features of the invention are set forth in the following claims.

I claim:

1. A marine propulsion device for a boat hull having a transom, said device comprising a steering post having a longitudinal axis and adapted to be connected to the boat transom for rotation about said longitudinal axis, a propulsion assembly including a rotatably mounted propelling element, and means connecting said propulsion assembly and said steering post for common pivotal movement about said longitudinal axis and for movement of said propulsion assembly relative to said steering post between a running position and a second position elevated from the running position and against steering movement of said propulsion unit assembly relative to said steering post, said means connecting said propulsion assemby and said steering post including means for selectively and rectilinearly displacing said propulsion unit assembly relative to said steering post between said running position and said second position, said means for selectively and rectilinearly displacing said propulsion assembly comprising a hydraulic cylinder having an axis and a piston moveable in and relative to said cylinder along said cylinder axis, means connecting said cylinder to said steering post with said cylinder axis in fixed relation to said steering post, and means connecting said propulsion assembly to said piston for common movement therewith and for connecting said propulsion assembly to said cylinder for propulsion assembly movement axially of said cylinder.

2. A marine propulsion device for a boat hull having a transom, said device comprising a steering post having a longitudinal axis and adapted to be connected to the boat transom for rotation about said longitudinal axis, a propulsion assembly including a rotatably mounted propelling element, and means connecting said propulsion assembly and said steering post for common pivotal movement about said longitudinal axis and for movement of said propulsion assembly relative to said steering post between a running position and a second position elevated from the running position and against steering movement of said propulsion unit assembly relative to said steering post, said means connecting said propulsion assembly and said steering post including means for selectively and rectilinearly displacing said propulsion unit assembly relative to said steering post between said running position and said second position, said means for selectively and rectilinearly displacing said propulsion assembly comprising a link which is extensible and contractable and which is connected, at one end, to said steering post and connected, at the other end, to said propulsion assembly, and means cooperating with said link for preventing pivotal movement in a vertical plane of said propulsion assembly with respect to said link.

3. A marine installation comprising a boat hull including a transom, a steering post having a longitudinal axis and rotatably carried by and aft of said transom about said longitudinal axis, a propulsion unit assembly including a rotatably mounted propelling element, and means connecting said propulsion unit assembly and said steering post for common pivotal movement about said longitudinal axis and for movement of said propulsion unit assembly relative to said steering post between a running position and a second position spaced from the running position and against other material movement of said propulsion unit assembly relative to said steering post, said means connecting said propulsion unit assembly and said steering post including means providing rectilinear movement of said propulsion unit assembly relative to said steering post between said running position and said second position, said means providing rectilinear movement of said propulsion assembly comprising a link which is extensible and contractable and which is connected, at one end, to said steering post and connected, at the other end, to said propulsion unit assembly, and further including means for preventing pivotal movement in a vertical plane of said propulsion unit assembly with respect to said link.

* * * * *